US009480353B1

(12) United States Patent
Chuang

(10) Patent No.: US 9,480,353 B1
(45) Date of Patent: Nov. 1, 2016

(54) CUP SLEEVE WITH HANDLE

(71) Applicant: Cheng-An Chuang, Tainan (TW)

(72) Inventor: Cheng-An Chuang, Tainan (TW)

( * ) Notice: Subject to any disclaimer, the term of this patent is extended or adjusted under 35 U.S.C. 154(b) by 30 days.

(21) Appl. No.: 14/696,514

(22) Filed: Apr. 27, 2015

(51) Int. Cl.

| | |
|---|---|
| ***B65D 25/22*** | (2006.01) |
| ***A47G 23/02*** | (2006.01) |
| ***B65D 81/38*** | (2006.01) |
| *B65D 25/28* | (2006.01) |

(52) U.S. Cl.
CPC ..... *A47G 23/0216* (2013.01); *B65D 25/22* (2013.01); *B65D 81/3876* (2013.01); *A47G 2023/0291* (2013.01); *B65D 25/2847* (2013.01)

(58) Field of Classification Search
CPC ..... A47G 2023/0291; A47G 2023/0275; A47G 2023/0283; A47G 23/0216; A47G 23/02; B65D 25/2847; B65D 81/3876; B65D 81/3881; B65D 81/3865; B65D 81/3869; B65D 81/3886
USPC ..... 220/738, 739
See application file for complete search history.

(56) References Cited

U.S. PATENT DOCUMENTS

| | | | |
|---|---|---|---|
| 1,910,168 | A | 5/1933 | Jacobs |
| 5,868,310 | A | 2/1999 | Leszczynski |
| 7,819,277 | B2 | 10/2010 | Hanson |
| 8,210,392 | B2 | 7/2012 | Kang et al. |

FOREIGN PATENT DOCUMENTS

WO WO02/087994 A1 11/2002

*Primary Examiner* — Anthony Stashick
*Assistant Examiner* — Mollie Llewellyn
(74) *Attorney, Agent, or Firm* — Alan D. Kamrath; Kamrath IP Lawfirm, P.A.

(57) ABSTRACT

A cup sleeve includes two opposing side walls, two opposing support brackets, and two opposing handles. The two opposing side walls are formed by folding a sheet of cardboard in half and joining two lateral edges of the sheet of cardboard, so that a beverage container can be placed between the side walls. The two opposing support brackets are respectively formed at the side walls. The two support brackets can be folded upwardly about their bottoms to extend above the top edges of the side walls. The two opposing handles are respectively formed at the two support brackets. The two handles can be folded outwardly about their bottoms to facilitate a user in taking the cup sleeve together with the beverage container. Moreover, the cup sleeve can provide the function of thermal insulation and heat preservation.

7 Claims, 7 Drawing Sheets

CUP SLEEVE WITH HANDLE

BACKGROUND OF THE INVENTION

The present invention relates to a cup sleeve and, more particularly, to a cup sleeve that is constructed of cardboard for holding a beverage container and allows to be taken by its handles.

Plastic bags are usually used for accommodating beverage cups. Although plastic bags are convenient for beverage cups and the required cost is low, they do not provide the function of heat preservation or thermal insulation and they are not biodegradable. Besides, since plastic bags cannot position beverage containers definitely, they are easy to tilt or tip over, thereby causing the contents of the beverage cups to flow out.

BRIEF SUMMARY OF THE INVENTION

It is an objective of the present invention to provide a cup sleeve that can hold a beverage container properly and has a pair of handles to facilitate a consumer to take it with the beverage container, wherein the cup sleeve is constructed of cardboard for meeting the requirement of environmental protection and providing the function of heat preservation and thermal insulation. Moreover, the cup sleeve is adequate in strength, simple in structure, and can be positioned definitely.

To achieve this and other objectives, the cup sleeve of the present invention includes two opposing side walls, two opposing support brackets, and two opposing handles. The two opposing side walls, including a first side wall and a second side wall, are formed by folding a sheet of paper material in half and joining two lateral edges of the sheet of paper material to form an enclosure that has the first side wall and the second side wall. The enclosure defines an open top by top edges of the first and second side walls and defines an open bottom by bottom edges of the first and second side walls. The two opposing support brackets include a first support bracket and a second support bracket, which are respectively formed at the first side wall and the second side wall. Each of the two support brackets has two spaced-apart legs and one intermediate portion connecting the legs, wherein each leg is formed together with the associated side wall at its bottom. When the cup sleeve is in an unused state, the first and second support brackets are located between the open top and the open bottom of the enclosure. When the cup sleeve is in a used state, the first and second support brackets are capable of being folded upwardly about the bottoms of their legs to extend above the top edges of the first and second side walls. The two opposing handles includes a first handle and a second handle, which are respectively formed at the first support bracket and the second support bracket, wherein each handle is formed together with the associated support bracket at its bottom. When the cup sleeve is in the unused state, the first and second handles are located within the first and second support brackets and between the open top and the open bottom. When the cup sleeve is in the used state, the first and second handles are capable of being folded outwardly about their bottoms to locate above the first and second support brackets.

In an embodiment, each of the first and second handles includes an opening therein for ease of taking the cup sleeve. At least one covering portion is defined between one support bracket and its associated handle to cover the beverage container.

The present invention will become clearer in light of the following detailed description of illustrative embodiments of this invention described in connection with the drawings.

DETAILED DESCRIPTION OF THE INVENTION

Figure 1A:
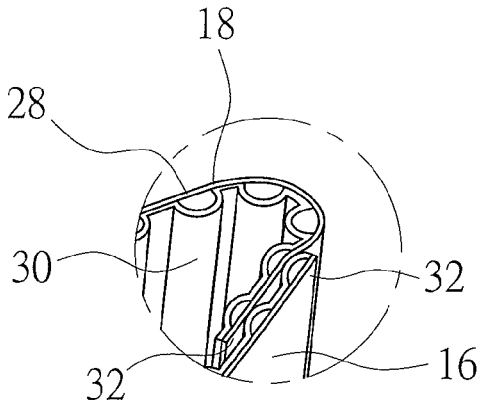
FIG. 1*a* shows an enlarged fragmentary view of an upper right corner of the cup sleeve of FIG. 1.
Figure 1:
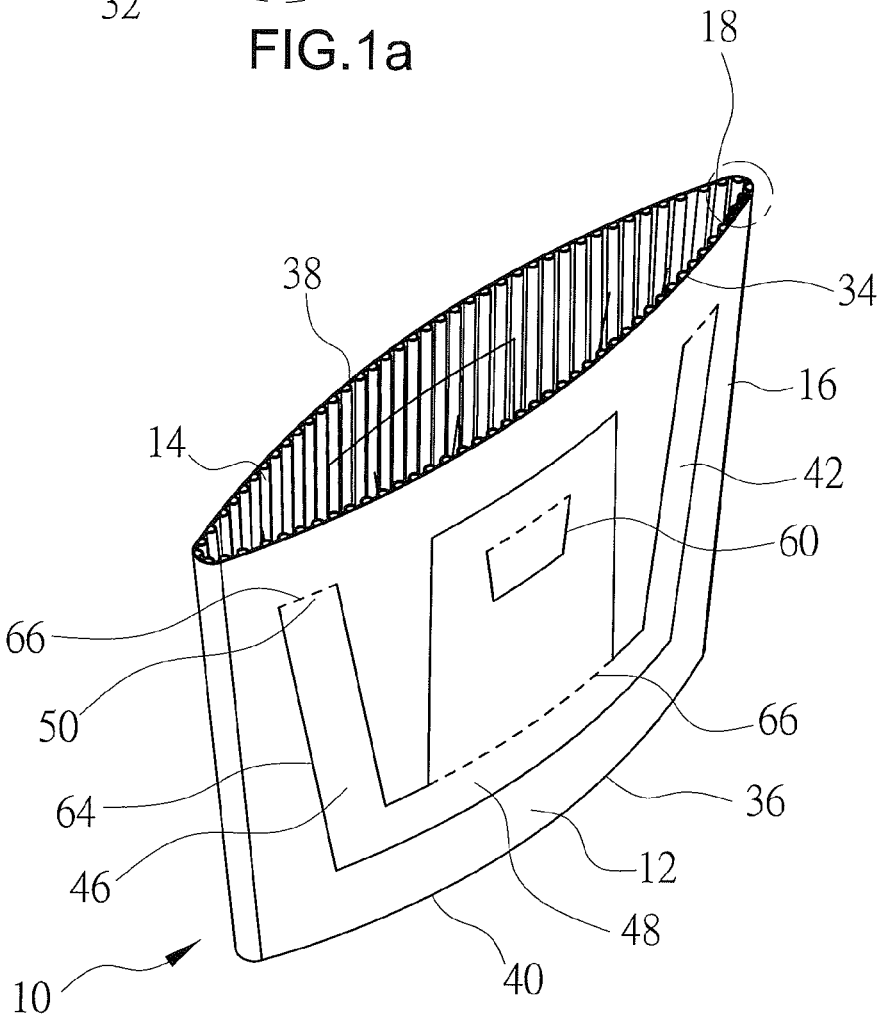
FIG. 1 shows a 3-dimensional view of a cup sleeve according to an embodiment of the present invention.
Figure 2:
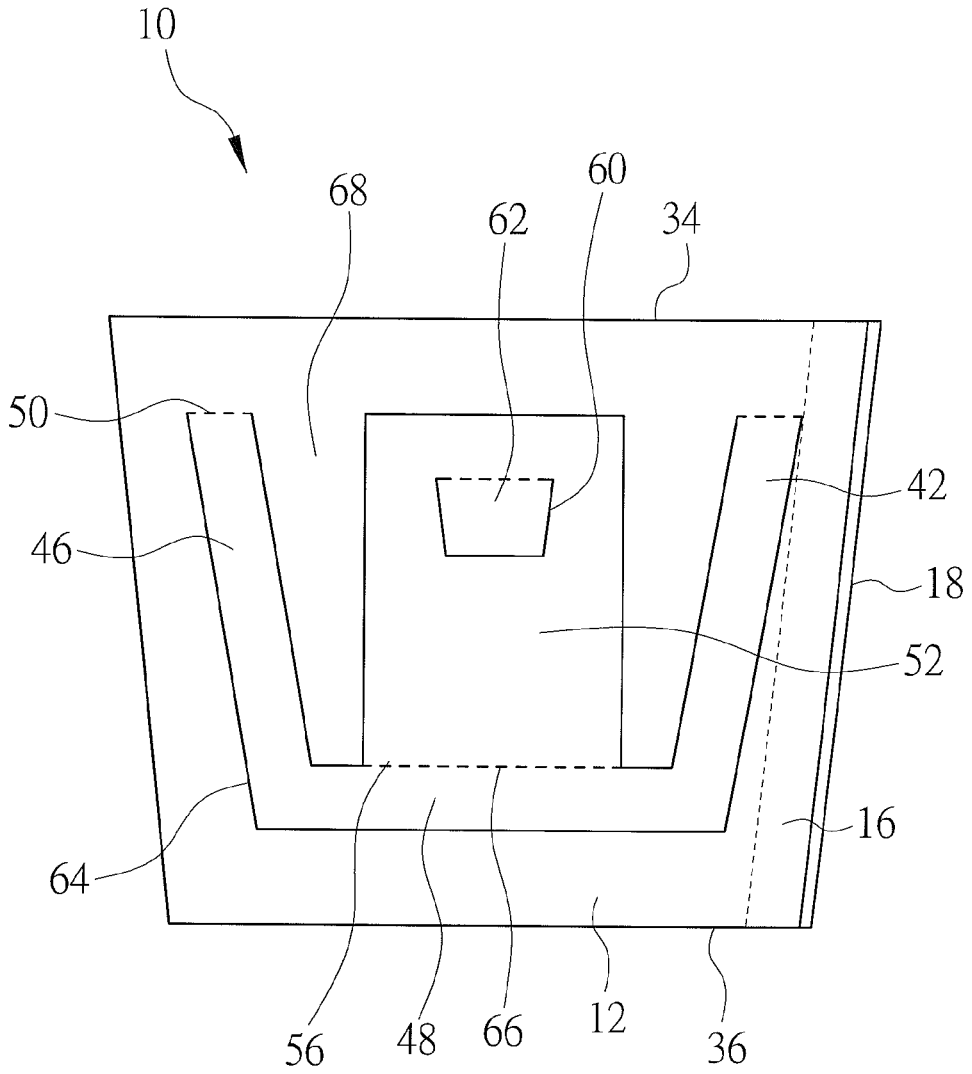
FIG. 2 shows a front view of the cup sleeve of FIG. 1.
Figure 3:
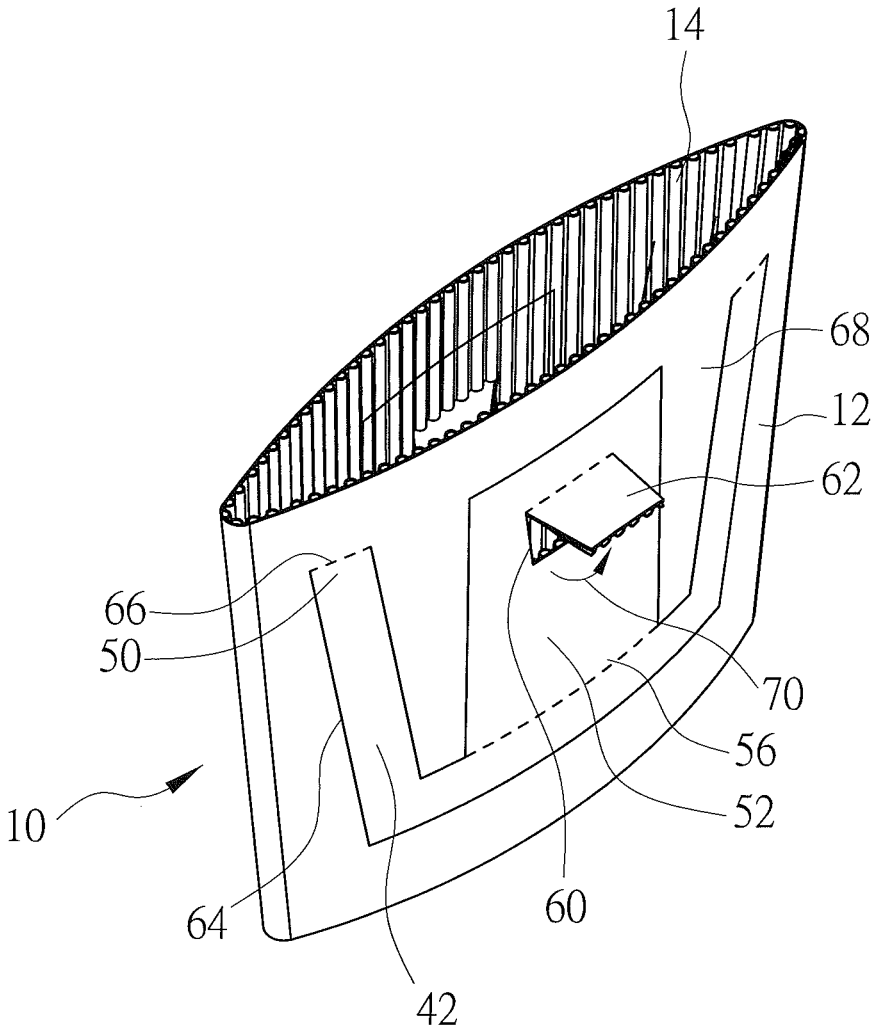
FIG. 3 shows a schematic view of the cup sleeve of FIG. 1, wherein two flaps are folded upwardly.
Figure 4:
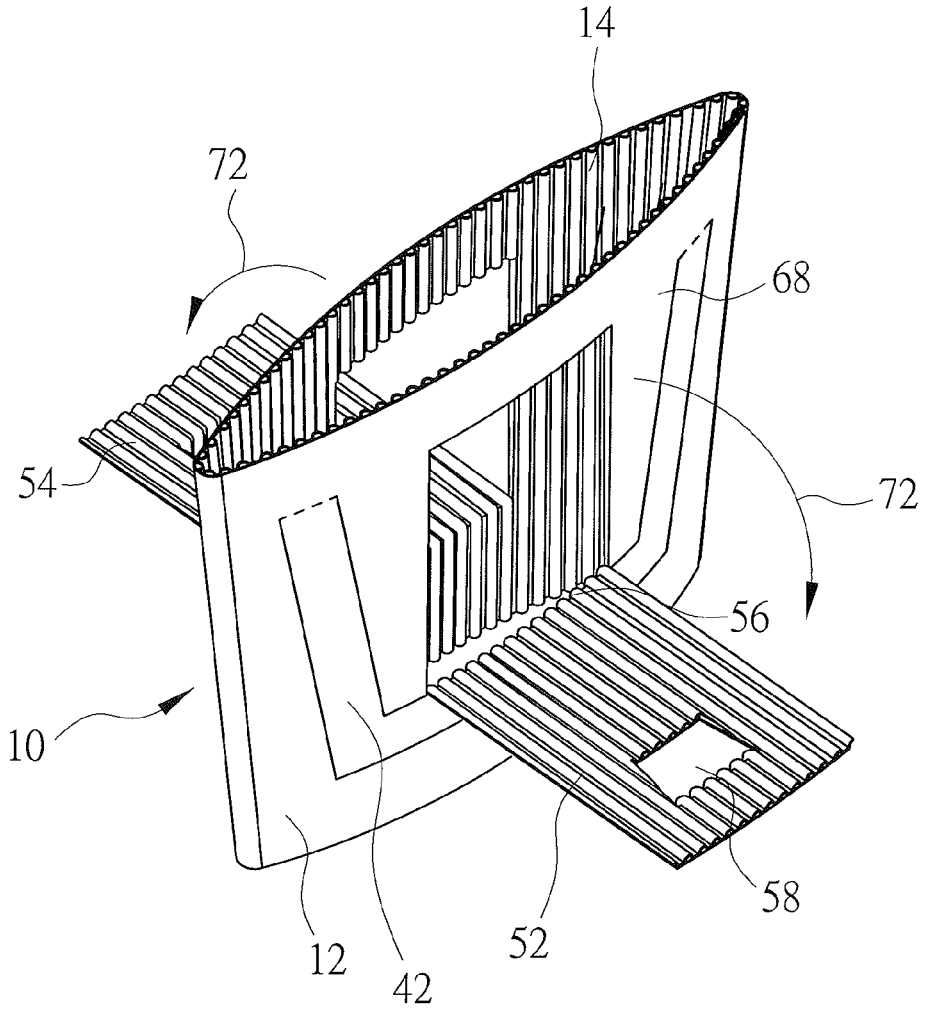
FIG. 4 shows a schematic view of the cup sleeve of FIG. 3, wherein two handles are folded outwardly.
Figure 5:
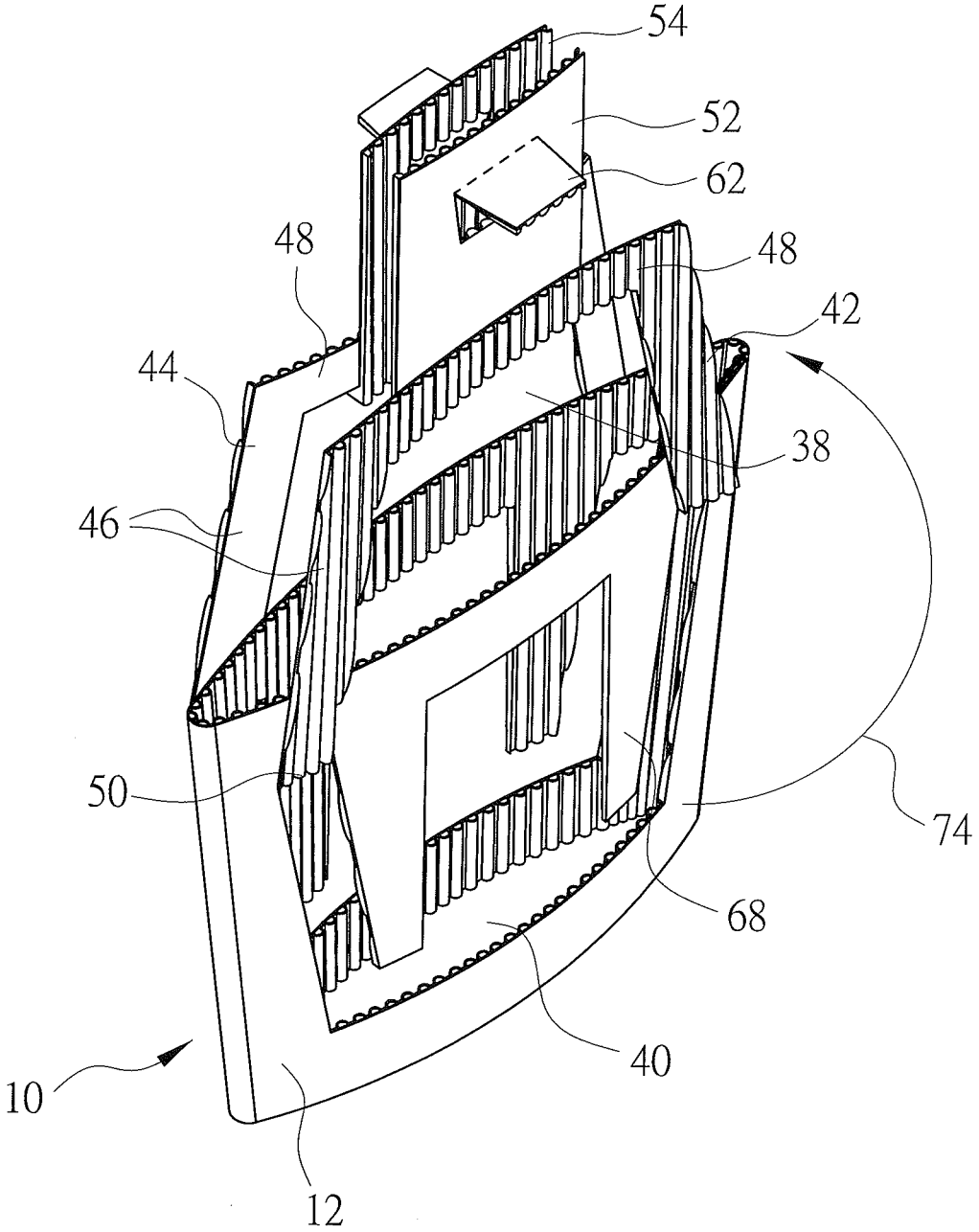
FIG. 5 shows a schematic view of the cup sleeve of FIG. 4, wherein two support brackets are folded upwardly.
Figure 6:
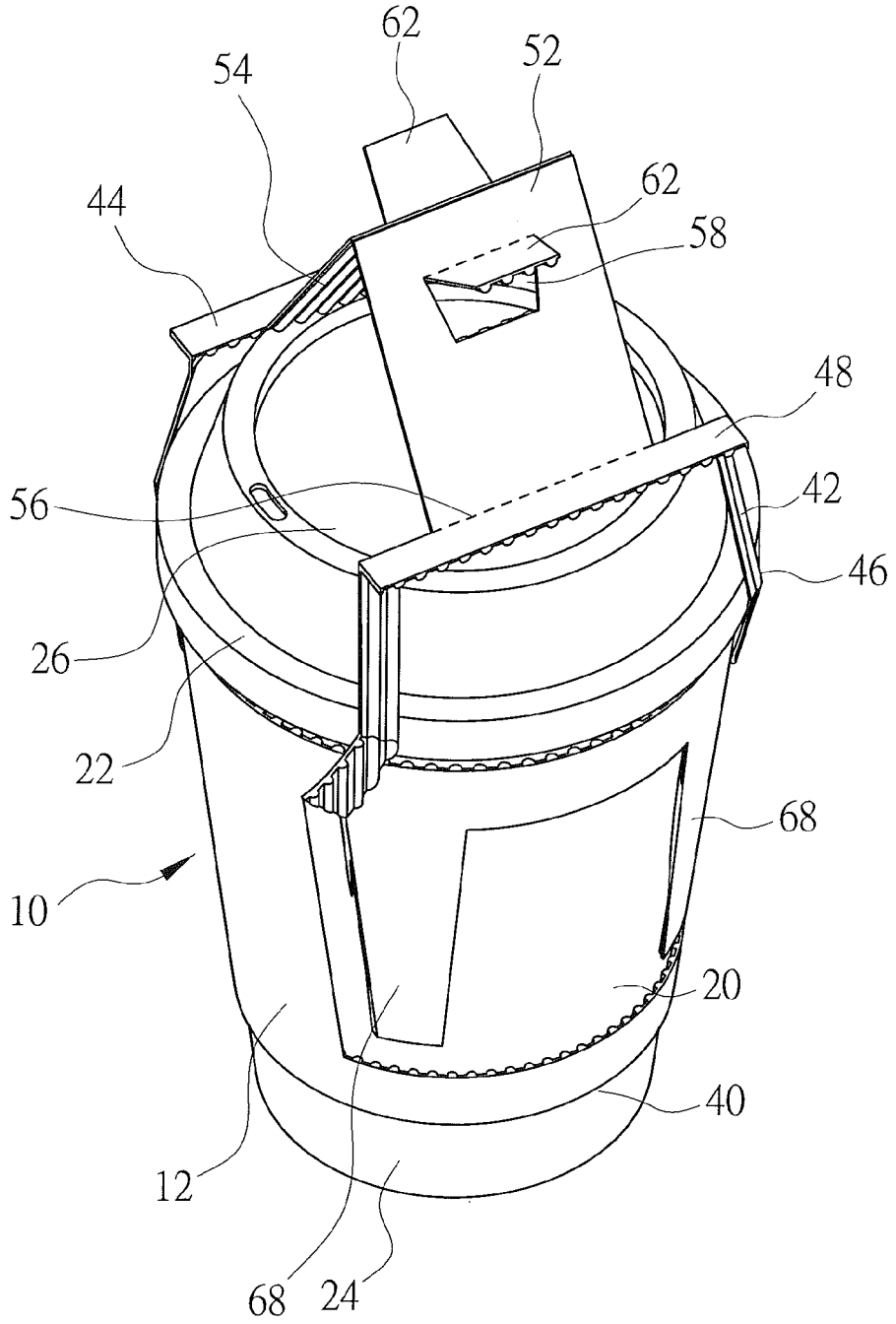
FIG. 6 shows an application view of the cup sleeve of FIG. 1, wherein a beverage container is held in the cup sleeve.

FIGS. 1 through 7 show a cup sleeve 10 of an embodiment of the present invention, which includes two opposing side walls including a first side wall 12 and a second side wall 14, both of which are formed by folding a sheet of paper material in half, wherein the first side wall 12 has a free lateral edge 16 whereas the second wall 14 has a free lateral edge 18, the two free lateral edges 16, 18 being joined together. The cup sleeve 10 can hold a beverage container 20, such as a beverage cup, therein. As shown, the beverage container 20, being substantially conical in shape, has an upper portion 22 and a lower portion 24, wherein the upper portion 22 has a diameter greater than the lower portion 24 (see FIG. 6). Furthermore, a cap 26 or a plastic diaphragm can be used to cover the upper portion 22 of the beverage container 20.

Preferably, the cup sleeve 10 is constructed of corrugated cardboard, which includes a flat liner 28 and a corrugated medium 30 (or called fluting medium) attached to one side of the flat liner 28 (see FIG. 1*a*), wherein the corrugated medium 30 can enhance the structural strength of the cup sleeve 10 and enable the cup sleeve 10 to provide the function of thermal insulation and heat preservation. In manufacturing, a sheet of corrugated cardboard, which has two lateral edges 32, can be folded in half to allow the two lateral edges 32 to be joined to form an enclosure which has the first side wall 12 and the second side wall 14. The enclosure defines an open top 38 by top edges 34 of the first and second side walls 12 and 14 and defines an open bottom 40 by bottom edges 36 of the first and second side walls 12 and 14, wherein the open top 38 has a dimension greater than the open bottom 40. Furthermore, the open bottom 40 has a dimension greater than a dimension of the bottom portion 24 of the beverage container 20, and the open top 38 has a dimension less than the top portion 22 of the beverage container 20, so that the bottom portion 24 of the beverage container 20 can insert through the open bottom 40, and the top portion 22 of the beverage container 20 can project out of the open top 38, so that the beverage container 20 can be securely positioned in the cup sleeve 10 (see FIG. 6).

The cup sleeve 10 further includes a first support bracket 42 and a second support bracket 44 opposing to the first support bracket 42, which are respectively formed at the first side wall 12 and the second side wall 14. In this embodiment, each of the two support brackets 42, 44, being substantially U-shaped, has two spaced-apart legs 46 and one intermediate portion 48 connecting the legs 46, wherein each leg 46 is formed together with the associated side wall at its bottom 50. Thus, when the cup sleeve 10 is in an unused state, the first and second support brackets 42 and 44 are located between the open top 38 and the open bottom 40 of the enclosure (see FIG. 1). When the cup sleeve 10 is in a used state, the first and second support brackets 42 and 44 are capable of being folded upwardly about the bottoms 50 of their legs 46 to extend above the top edges 34 of the first and second side walls 12 and 14 (see FIG. 5).

The cup sleeve 10 further includes a first handle 52 and a second handle 54 opposing the first handle 52, which are respectively formed at the first support bracket 42 and the second support bracket 44 between the open top 38 and the open bottom 40. In this embodiment, each handle, being rectangular in shape, is formed together with the associated support bracket at its bottom 56. The first and second handles 52 and 54 can be folded outwardly with respect to the first and second support brackets 42 and 44 (see FIG. 4) or can be collapsed to its original position, where they are located within the first and second support brackets 42 and 44, between the open top 38 and the open bottom 40 (see FIG. 1). Furthermore, a substantially U-shaped cut line 60 can be provided on each of the first and second handles 52 and 54 to form a flap 62 thereon. Each flap 62 can be raised or folded upwardly about its bottom to define an opening 58 in each handle 52, 54. The openings 58 of the first and second handles 52 and 54 allow a user's fingers to insert therethrough for ease of taking the cup sleeve 10 together with the container 20. Alternatively, each opening 58 can be formed by a rectangular cut in each handle 52, 54 (see FIG. 7). When the cup sleeve 10 is in an unused state, the first and second handles 52 and 54 are located within the first and second support brackets 42 and 44 and between the open top 38 and the open bottom 40. When the cup sleeve 10 is in a used state, the first and second handles 52 and 54 are capable of being folded outwardly about their bottoms 56 to locate above the first and second support brackets 42 and 44.

Figure 7:
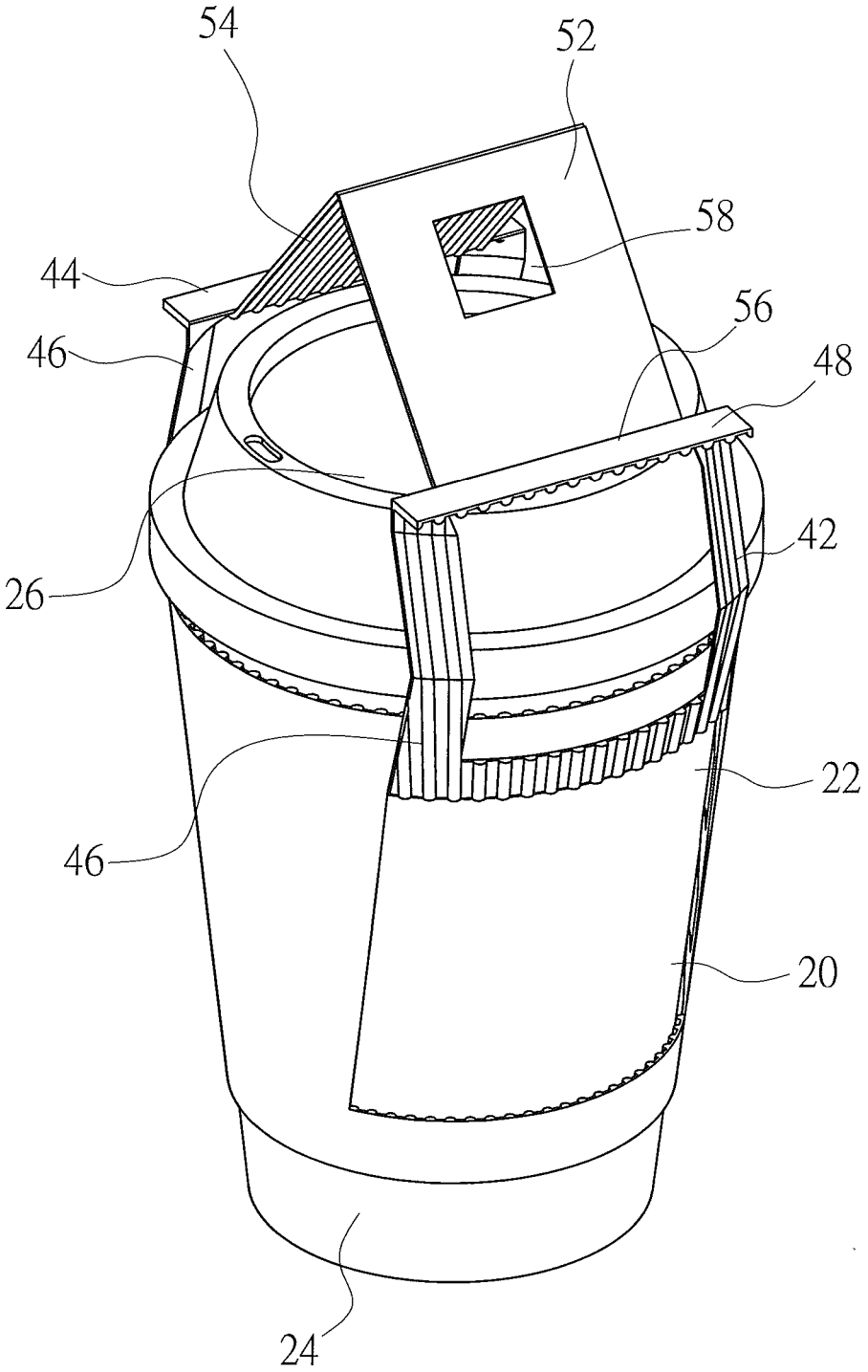
FIG. 7 shows an application view of a cup sleeve according to another embodiment of the present invention, wherein a beverage container is held in the cup sleeve.

The first and second support brackets 42 and 44 and the first and second handles 52 and 54 are formed by cut lines 64 and fold lines 66 on each of the first and second side walls 12 and 14, wherein two of the fold lines 66 are located at the bottoms 50 of the legs 46 of each support bracket 42, 44 and thus allow the support bracket 42, 44 to be folded upwardly. One of the fold lines 66 is located at the bottom 56 of each handle 52, 54 and thus allows the handle to be folded outwardly. Furthermore, the cut lines 64 and the fold lines 66 on each of the first and second side walls 12 and 14 are configured such that two covering portions 68 are defined between the associated support bracket and the associated handle, so that when the first and second support brackets 42 and 44 and the first and second handles 52 and 54 are folded upwardly, the covering portions 68 can be left to cover the beverage container 20 (see FIG. 6). Alternatively, as shown in FIG. 7, the covering portions 68 can be removed from the cup sleeve 10; namely, each of the first and second handles 52 and 54 can be arranged to adjoin the legs 46 of the associated support bracket without a covering portion located therebetween.

FIGS. 3 through 6 show an operation of the cup sleeve 10. In use, firstly, the two flaps 62 can be folded upwardly (shown by arrow 70 in FIG. 3). Secondly, the first and second handles 52 and 54 can be folded outwardly (shown by arrow 72 in FIG. 4). Thirdly, the first and second support brackets 42 and 44 can be folded upwardly (shown by arrow 74 in FIG. 5). Fourthly, the first and second side walls 12 and 14 can be moved outwardly to allow the beverage container 20 to be placed between the two side walls 12, 14, whereby the beverage container 20 can be positioned properly. Finally, the first and second handles 52 and 54 can be moved to contact each other, and thus a user's fingers can inserted through the openings 58 for ease of taking the cup sleeve 10 together with the beverage container 20.

In addition to the easy-carrying advantage of the cup sleeve 10, since the cup sleeve 10 is constructed of cardboard, it can provide the function of thermal insulation and heat preservation. Furthermore, the cup sleeve 10 has a structural strength more than plastic bags and thus has a longer life span, so that it can be reused and thus be more environmentally friendly.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A cup sleeve for holding a beverage container, comprising:

two opposing side walls including a first side wall and a second side wall, which are formed by joining two lateral edges of a sheet of paper material to form an enclosure that has the first side wall and the second side wall, wherein the enclosure defines an open top by top edges of the first and second side walls and defines an open bottom by bottom edges of the first and second side walls;

two opposing support brackets including a first support bracket and a second support bracket, which are respectively formed on the first side wall and the second side wall, each of the two support brackets having two spaced-apart legs and one intermediate portion connecting the two legs, each leg being cut out from within an associated side wall, wherein when the cup sleeve is in an unused state, the first and second support brackets are located between the open top and the open bottom of the enclosure; when the cup sleeve is in a used state, the first and second support brackets are folded upwardly about the bottoms of their legs to extend above the top edges of the first and second side walls; and two opposing handles including a first handle and a second handle, which are respectively formed on the first support bracket and the second support bracket, each handle being formed together with an associated support bracket at its bottom, wherein when the cup sleeve is in the unused state, the first and second handles are located within the associated support bracket and between the open top and the open bottom; when the cup sleeve is in the used state, the first and second handles are capable of being folded outwardly about their bottom to locate above the first and second support brackets.

2. The cup sleeve of claim 1, wherein each of the first and second handles includes an opening therein for ease of taking the cup sleeve.

3. The cup sleeve of claim 2, wherein each of the first and second handles is provided with a flap, which is foldable at its bottom to form the opening.

4. The cup sleeve of claim 1, wherein the first and second side walls are formed by folding a sheet of cardboard in half and joining two lateral edges of the sheet of cardboard, each of the first and second support brackets is substantially U-shaped, and the open top of the enclosure has a dimension greater than a dimension of the open bottom of the enclosure.

5. The cup sleeve of claim 4, wherein each of the first and second support brackets and each of the first and second handles are formed by cut lines and fold lines on each of the first and second side walls, wherein two of the fold lines are located at the bottoms of the two legs of each support bracket and allow the support bracket to be folded upwardly, wherein one of the fold lines is located at the bottom of each handle and allows the handle to be folded outwardly.

6. The cup sleeve of claim 4, wherein at least one covering portion is defined between each of the first and second support brackets and its associated handle to cover the beverage container.

7. The cup sleeve of claim 4, wherein each of the first and second handles includes an opening therein for ease of taking the cup sleeve.

* * * * *